US006681698B2

(12) United States Patent
Wehmeier et al.

(10) Patent No.: US 6,681,698 B2
(45) Date of Patent: Jan. 27, 2004

(54) INK BLADE ADJUSTING MECHANISM HAVING SHAPE MEMORY MATERIAL ACTUATOR

(75) Inventors: Hans-Willi Wehmeier, Lage (DE); Olli Saarniaho, Vaasa (FI)

(73) Assignee: Veslatec Oy (FI)

( * ) Notice: Subject to any disclaimer, the term of this patent is extended or adjusted under 35 U.S.C. 154(b) by 0 days.

(21) Appl. No.: 10/150,647

(22) Filed: May 16, 2002

(65) Prior Publication Data

US 2002/0195011 A1 Dec. 26, 2002

(30) Foreign Application Priority Data

May 17, 2001 (EP) ..... 01660097

(51) Int. Cl.[7] ..... B41F 31/05; B41F 31/02
(52) U.S. Cl. ..... 101/365; 101/485; 101/DIG. 47
(58) Field of Search ..... 101/365, 484, 101/485, DIG. 47

(56) References Cited

U.S. PATENT DOCUMENTS

| | | | | |
|---|---|---|---|---|
| 4,119,836 A | | 10/1978 | Motokawa | |
| 4,328,748 A | | 5/1982 | Schramm | |
| 4,581,994 A | * | 4/1986 | Wildmann | 101/363 |
| 5,052,297 A | | 10/1991 | Albiez | |
| 5,958,154 A | | 9/1999 | O'Handley et al. | |
| 5,983,798 A | * | 11/1999 | Iijima et al. | 101/365 |
| 6,062,139 A | * | 5/2000 | Tomita et al. | 101/365 |
| 6,157,101 A | | 12/2000 | Ullakko | |
| 2002/0088358 A1 | * | 7/2002 | Hofheinz et al. | 101/365 |

FOREIGN PATENT DOCUMENTS

| | | |
|---|---|---|
| DE | 2951653 | 12/1979 |
| DE | 91 12 926.5 | 10/1991 |
| EP | 425432 | 10/1990 |
| WO | WO 99/45631 | 9/1999 |

OTHER PUBLICATIONS

Kakeshita and Shimizu, "Magnetoelastic Martensitic Transformation", Scripta Metallurgica, vol. 19, pp. 973–976, 1985.

Webster, "Magnetic order and phase transformation in $Ni_2MnGa$", Philosophical magazine B, 1984, vol. 49, No. 3, 295–310.

Kyprianidis et al., "Magnetic phase transitions in FeCrBSi alloys", Journal of Magnetism and Magnetic Materials 161 (1996) 203–208.

* cited by examiner

*Primary Examiner*—Andrew H. Hirshfeld
*Assistant Examiner*—Leo T. Hinze
(74) *Attorney, Agent, or Firm*—Thorpe North & Western

(57) ABSTRACT

The invention relates to an adjusting mechanism for zonal control of an ink blade (2) in respect of a ductor roller surface (5) in a printing press. The adjusting mechanism comprising a plurality of moving means (1) in contact with the ink blade and movable in a longitudinal direction (P1, P2) towards and away from said ductor roller. Each moving mean comprises at least one bar (6) of a shape memory material (SMM) and activating means (7) to provide e.g. a magnetic field strength (H±ΔH) bar(s). A controlled electrical voltage/current (U, I) is fed into the activating means, whereupon a variable length (L±ΔL) of said bar is determined for said adjustment.

29 Claims, 4 Drawing Sheets

INK BLADE ADJUSTING MECHANISM HAVING SHAPE MEMORY MATERIAL ACTUATOR

This application claims priority of European Application No. 01660097.5, filed May 17, 2001.

The invention relates to an adjusting mechanism for zonal control of an ink blade in respect of a ductor roller surface in a printing press having a frame, said adjusting mechanism comprising a plurality of moving means in contact with the ink blade and movable in a longitudinal direction towards and away from said ductor roller. The invention also relates to a method for zonal control of an ink layer thickness on a ductor roller by adjusting position of an ink blade in respect of a ductor roller surface in a printing press, in which method a plurality of moving means in contact with the ink blade are moved independently of each other in a longitudinal direction towards and away from said ductor roller.

Ink blades are used in ink supply units of printing presses, especially rotary printing presses like offset printing machines, together with a ductor roller or an ink fountain roller, for controlling the thickness of ink layer supplied to the actual printing roller, and so for controlling the amount of ink on the printing sheet. Publication EP-0 425 432 describes an ink blade, whose the free end section associated with the ductor roller comprises a plurality of slits or cuts, which are perpendicular to longitudinal direction of the free end, to create a zonal segmentation or tongues of the ink blade. Bending the each zonal segment individually towards the ductor roller and away from it alters the gap between the ductor roller and these zonal segments of the free end section. This bending is performed by adjusting mechanisms which are arranged side by side so that the head of the adjuster screw in each of said mechanisms are non-positively connected to one of the zonal segments. This kind of adjusting mechanism is disclosed in publication EP-0 425 432. The adjuster screw is provided with a zone screw passing through a crossbar, whereupon turning of the zone screw to one or the opposite direction displaces the head of the adjuster screw bending more or less the tongue of the ink blade. This type of variable bending alters the gap between the ductor roller and the tongue of the ink blade, and so affects the thickness of the ink layer on the ductor roller. The position of the head is indicated with a meter counting the turns of the zone screw. These kind of adjusting mechanisms using screws, gears, levers or the like have several drawbacks. Because at least some part(s) of the mechanism shall be moved in two directions opposite to each other the always inevitable backlash or slack back between the mechanical components causes an uncontrolled deviation from the ink layer thickness strived for. Further the size of the adjusting mechanism cannot in practise be miniaturized to whatever extent, and so the width of the tongues is limited to be 25 mm or greater. This lowest limit hampers reaching the best possible control of the ink layer thickness. The different bending ratio of the adjacent tongues of the ink blade creates lateral breaks in the free end section, whereupon streaks of ink are formed in the cut areas between the tongues extending along the periphery of the ductor roller, and causing streaks in the final print, too. Also the construction of this kind of adjusting mechanisms is complicated and requires high precision manufacturing methods, both of which causing higher production costs.

Publication DE-G-91 12 926 discloses an apparatus for zonal dosing of a fluid on a roller in a printing machine with dosing elements with a zonal breadth, which elements have supporting and dosing areas in direction of the roller axle, whereupon said supporting areas are continuously resting against the roller and whereupon said dosing areas of the dosing elements can be positioned at distances, which can be altered independently from each other. This is achieved by arranging the dosing areas of the dosing elements to consist of piezo-electric setting elements. There is no ink blade, but the piezo-electric elements are in direct contact with the roller surface. These piezo-electric elements does not control the amount of fluid fed onto the roller, but the piezo-electric elements operate to scrape afterwards the surplus fluid from the roller surface.

Publication DE-29 51 653 describes an apparatus for dosing a colorant onto the ductor roller in a printing machine, in which the amount of colorant applied in the coloring device is defined by a dosing strip, which can be zonally controlled by steering impulses and setting elements, whereupon each dosing zone of the dosing strip is provided with setting means, and these dosing zones are positioned with forms of impulses continuously during colorant feeding at the ductor roller, i.e. creating a determined gap, and whereupon the time of the stroke in each dosing zone is variable. The dosing strip includes several base plates placed side by side and movable in the direction of the ductor roller, and there is at least two slides movable in the direction of the ductor roller on each of the base plates, and each slide on the base plate is brought in groups alternately as a supporting element or as a dosing element for the ductor roller, and the single slides are operated by single drives acting on the slides. The publication does not describe the type of the drives, and the only active elements are ordinary helical springs. The dosing strips seem to be quite thick, and so very stiff, whereupon they cannot be driven against the ductor roller.

The object of the invention is to achieve an adjusting mechanism and a method for zonal control of an ink blade in respect of a ductor roller providing an accurate alteration of the gap between the roller surface and the edge of the ink blade, in which alteration movement the backlash should be as small as possible, or the alteration should be free from backlash. The second object of the invention is to achieve an adjusting mechanism enabling to minimize the widths for the tongues of the ink blade. A further object of the invention is to achieve an adjusting mechanism by which streaks of ink on the ductor roller can be avoided to a considerable extent. Still further object of the invention is to achieve an adjusting mechanism and a method enabling automation of said zonal control, though not necessarily a feedback regulation.

The above-described problems can be solved and the above-defined objects can be achieved by means of an adjusting mechanism and by means of a method as set forth by the invention. According to the first aspect of the inventive apparatus each of said moving means comprises: at least one bar of a shape memory material having a length at least partly in said longitudinal direction, a first end of the bar(s) being supported by said frame and a second end thereof adapted to said contact, and activating means positioned to provide a magnetic field strength or a temperature or an electrical voltage and current into said bar or bars; and said adjusting mechanism comprises: a control unit supplying a controlled electrical voltage/current into the activating means, whereupon the length of said bar is determined by the magnetic field strength or the temperature or the electrical voltage/current thereof. According to the second aspect of the inventive apparatus each of said moving means comprises: at least one bar of a shape memory material having a length at least partly in said longitudinal direction, and activating means positioned to provide a magnetic field strength or a temperature or an electrical voltage and current into said bar or bars; and said adjusting mechanism comprises: at least one force sensor to detect compression forces between said ink blade and said ductor roller, and a control unit supplying a controlled electrical voltage/current responsive to said compression forces into the activating means. According to the inventive method a higher or a lower electrical voltage/current and/or an inverse electrical voltage/current is provided into activating means for bar(s) of a shape memory material arranged within each of the moving means, whereupon a magnetic field strength or a temperature or a voltage/current in said bar is changed altering a dimension of said bar(s) thereby adjusting the position of the ink blade.

This invention describes a new principle of attaining small movement for the edge of the ink blade, or especially small movements for the edges of the ink blade segments. This new principle utilizes a bar of a Shape Memory Material (SMM) connected between the frame of the printing press and the edge area of the ink blade. In this context Shape Memory Material (SMM) intends any material having some kind of repeatability, i.e. memory, reached by any means. So the memory properties of SMM are not limited to any special type of transformation, but are based on some transformation in the material. Accordingly Shape Memory Material (SMM) may change its form or dimension because of transformation caused by change in temperature, or change in strength or direction of a magnetic field, or change in strength or direction of an electrical voltage or current. A material having only a volume change caused by the simple thermal expansion is not considered as a SMM, but Shape Memory Alloys (SMA) of any type, electrostrictive materials, magnetostrictive materials as well as piezoelectric materials are included the group of Shape Memory Materials (SMM). The main advantage of using SMM bars according to invention is that the length of the bar can be electrically or electronically controlled with high accuracy, whereupon a movement accuracy and repeatability of an order of 1 $\mu$m for the edge of the ink blade can be reached. It is also possible to attain a movement of said edge without any noticeable backlash. Another advantage of using SMM bars according to invention is that the width of the blade segments can be reduced at least down to 12 mm. Further, utilizing the novel construction of the ink blade segments, it is possible to avoid the streaks of ink between the blade segments or tongues. All these features of the invention are effective in minimizing the size of the whole ink fountain in the printing press, and in minimizing the investment required.

The invention is now described in detail with reference made to the drawings.

Figure 5:
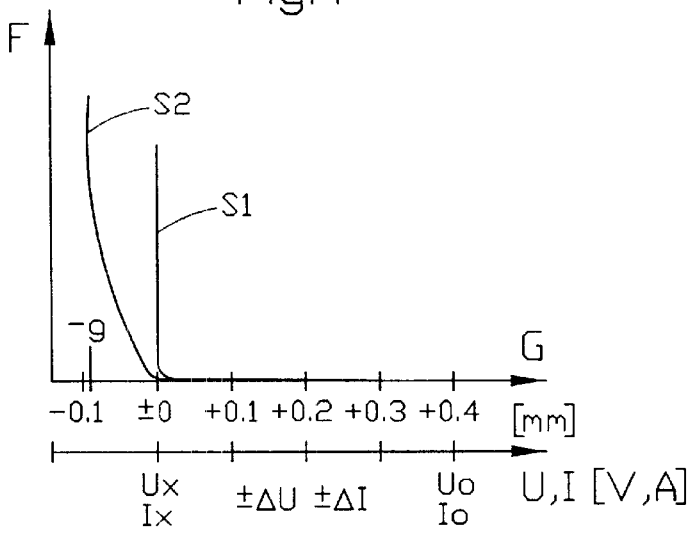

FIG. 5 exemplifies the forces detected under driving of the ink blade until a contact between the edge of the ink blade and the ductor roller is created, and the play in the bearings of the ductor roller is at least partly pushed to its one boundary. These points are utilized for initializing of the positioning data.

Figure 1A:
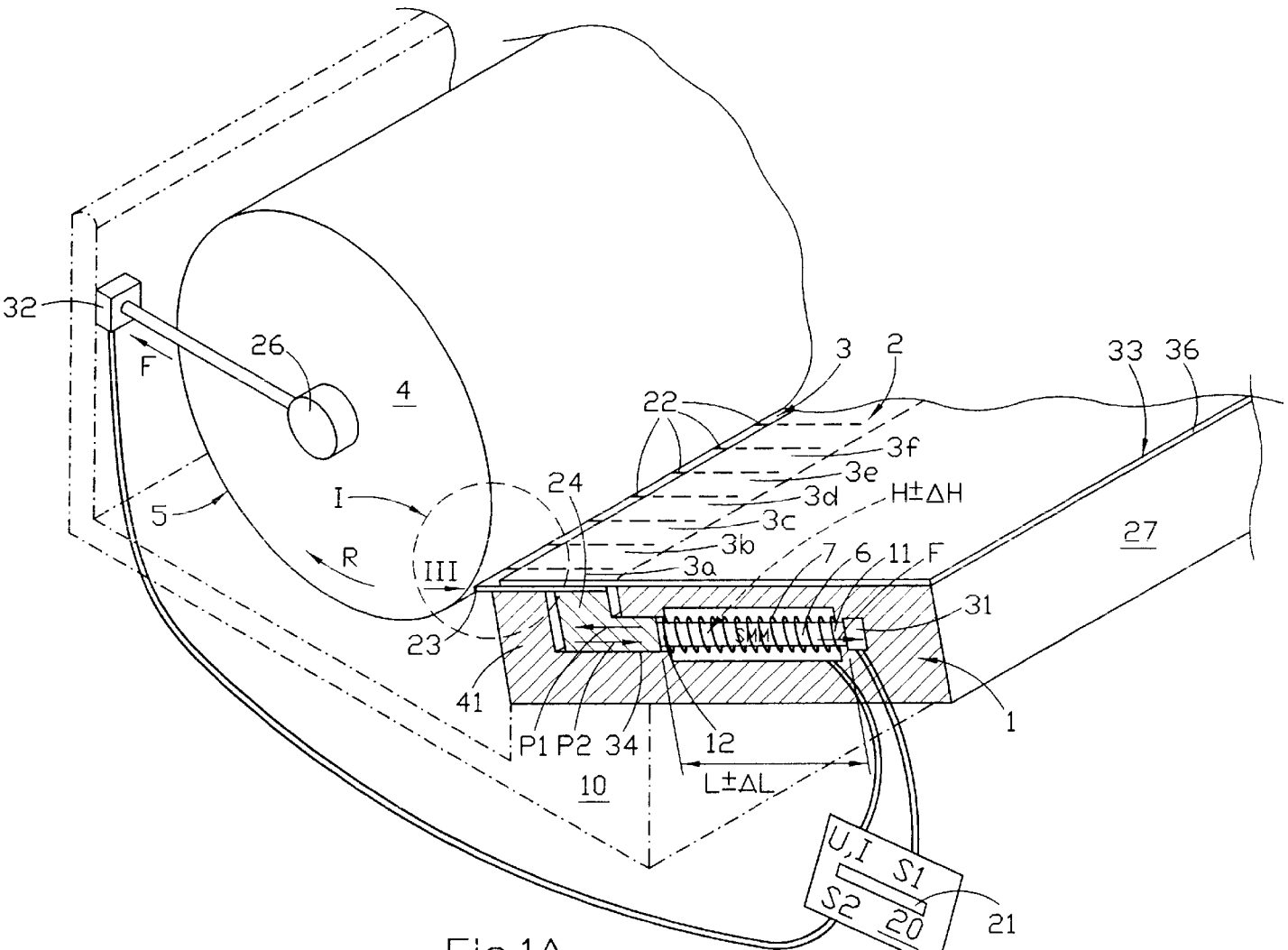
FIG. 1A illustrates schematically the first embodiment of the adjusting mechanism for zonal control of an ink blade according to the invention, in which the segments of the ink blade are linearly moved, partly in an axonometric view and partly in cross-section perpendicular to the axis line of the ductor roller.
Figure 6:
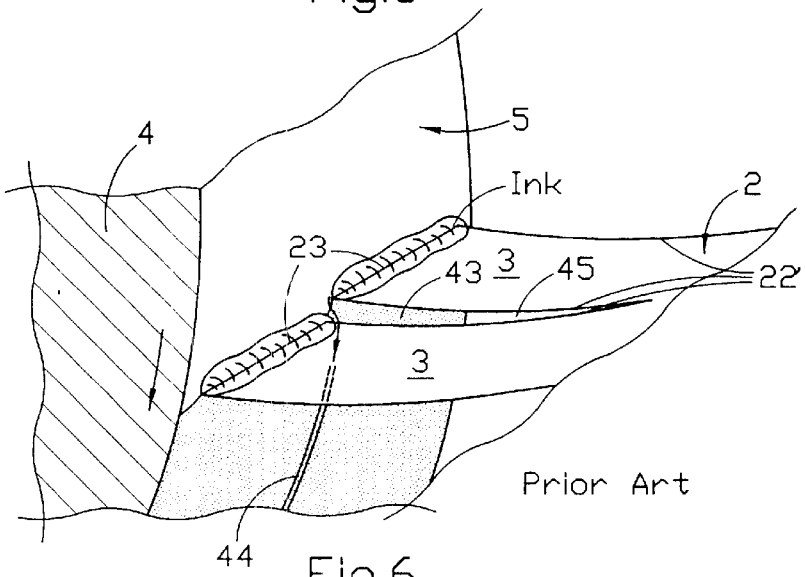

FIG. 6 illustrates the formation of ink streaks through the spacings between adjacent blade segments under their bending, in the same axonometric view as FIG. 1A.

Figures 1B, 3, 7:
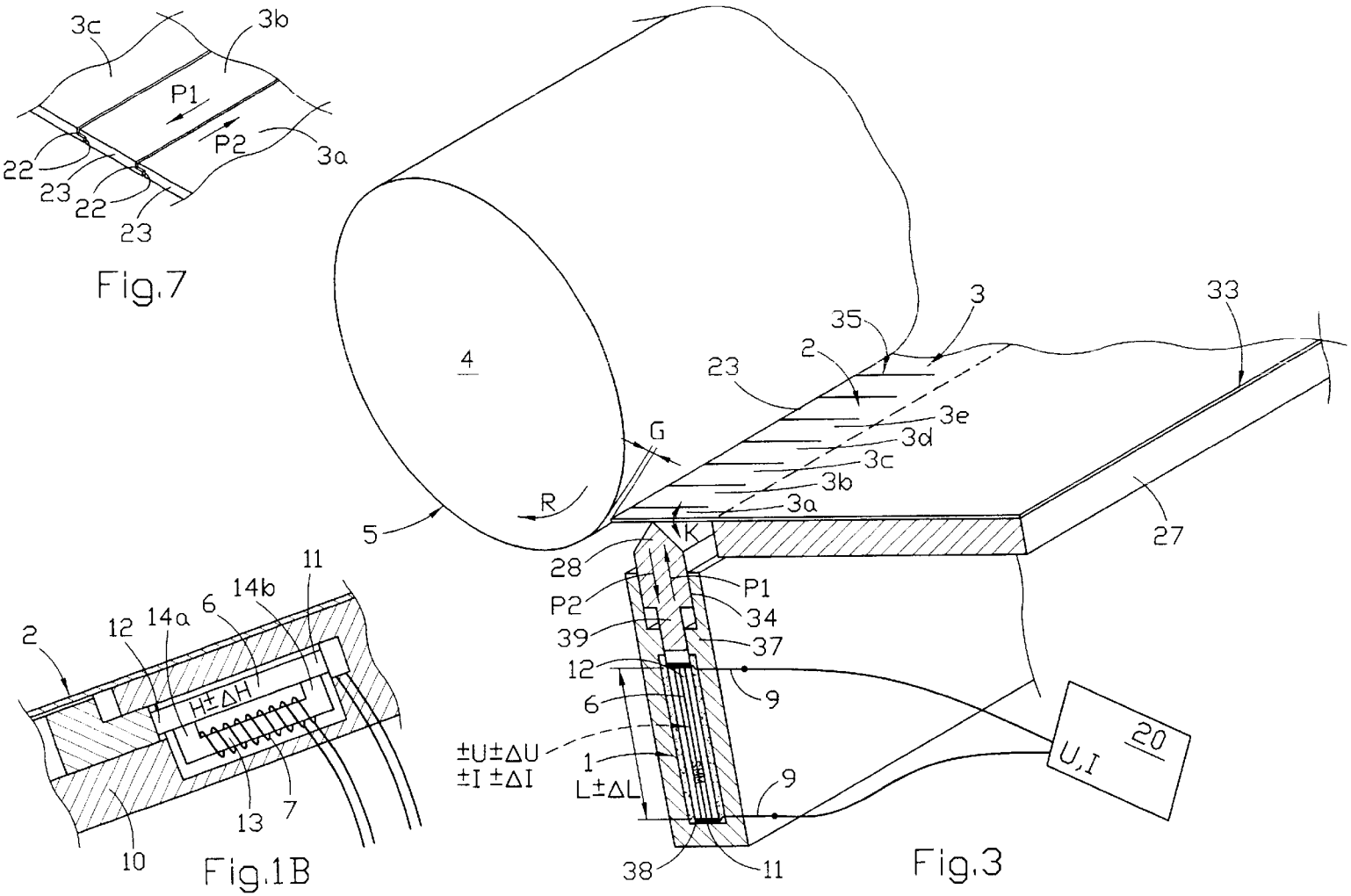
FIG. 1B illustrates schematically an alternative configuration of the moving means in the first embodiment of the adjusting mechanism according to FIG. 1A, and in the same view as in FIG. 1A.
FIG. 3 illustrates schematically the third embodiment of the adjusting mechanism for zonal control of an ink blade according to the invention, in which the segments of the ink blade are moved by bending, in the same view as in FIGS. 1A and 2A.

FIG. 7 illustrates one possible configuration for the longitudinally gliding sides of the separate blade segments according to the invention, seen in the direction III of FIG. 1A.

Figure 2B:
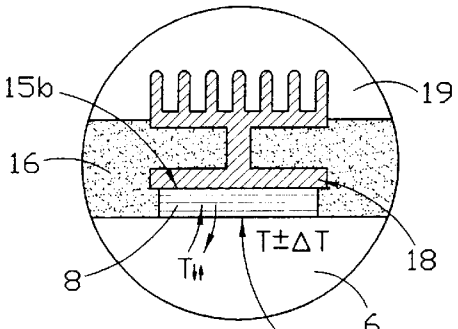
FIG. 2B illustrates a detail for altering the temperature of the bar in the moving means of the second embodiment of the adjusting mechanism according to FIG. 2A, in the area II of FIG. 1A and shown in a larger scale.
Figure 2A:
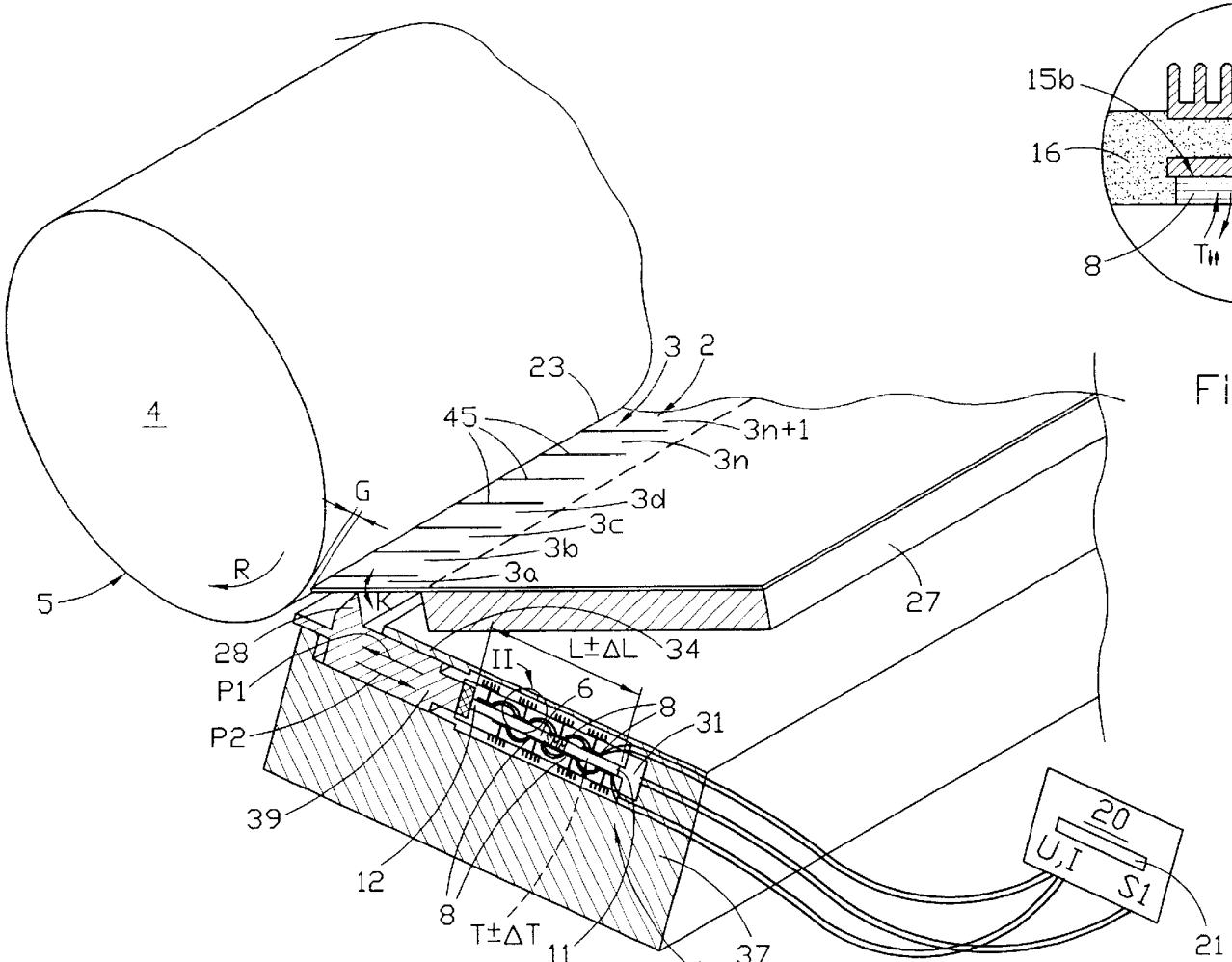
FIG. 2A illustrates schematically the second embodiment of the adjusting mechanism for zonal control of an ink blade according to the invention, in which the segments of the ink blade are moved by bending, in the same view as in FIG. 1A.
Figure 4:
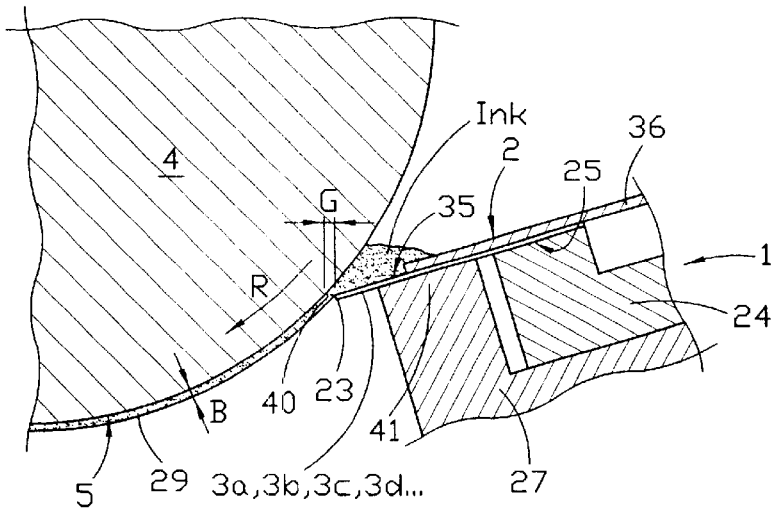
FIG. 4 illustrates the control of the ink layer thickness by the gap between the ductor roller and the edge of the ink blade in greater detail, in the area I of FIG. 1A and in the same cross-section, but shown in a larger scale.

Ink fountains, whose principle components are shown in the figures, comprise an ink blade 2 and a ductor roller 4. The ductor roller rotates to a direction R and the ink blade 2 has an inking edge 23 adjacent to the ductor roller 4 so that there is a variable and controlled gap 40 between the outer surface 5 of the ductor roller. The rotation direction R is downwards at the area of the inking edge 23, and the ink blade 2 is at least somewhat tilted as compared to horizontal so that the inking edge 23 is lower than the opposite edge area 33. So an upwards open trough 30 is formed between the upper side 35 of the ink blade and the surface 5 of the ductor roller above the ink blade for receiving an amount of Ink as shown in FIG. 4. In case there is a support plate 36 for the ink blade 2 positioned on the upper side 35 thereof and parallel to the ink blade, the Ink received can of course extend somewhat onto this support plate 36, too. The width G of the gap 40 defines the thickness B of the ink layer 29 below the inking edge 23 on the outer surface 5 of the ductor roller, and the ink layer is then removed from the ductor roller for further use in the printing press. This removing is not shown in the figures. Said width G of the gap 40 is altered and controlled by an adjusting mechanism discussed later in detail. The ductor roller has an axel 26 supported by bearings, not shown in the figures, in the a frame 10 of the printing press. The ink blade 2 and its optional support plate 36 are attached to the body 27 of the adjusting mechanism or to a separate body 27. The adjusting mechanism according to the invention can be built in inside this body, as shown in FIG. 1A, or the adjusting mechanism according to the invention can be positioned inside a separate body 37, as shown in FIGS. 2A and 3. These bodies 27, 37 are also attached to the frame 10—marked schematically by dashed pointed line in FIG. 1A—in a way not shown in the figures.

According to a first aspect of the invention the adjusting mechanism comprising a plurality of moving means 1 in contact with the ink blade 2 and movable in a longitudinal direction P1, P2 towards and away from said ductor roller 4. There is always one moving means 1 arranged to move or transfer one ink blade segment 3*a*, 3*b*, 3*c*, 3*d* . . . , a reference number 3 is used to indicate ink blade segments generally or any one of those ink blade segments, which segments are described later. Accordingly every ink blade segment, forming a zone, is moved and adjusted individually meaning zonal control of the ink blade. Each of the moving mean 1 according to the invention comprises at least one bar 6 of a shape memory material SMM having a length L at least partly in said longitudinal direction P1, P2. Each of the moving mean 1 according to the invention comprises also activating means 7 or 8 or 9. The first end 11 of the bar or bars 6 is supported by the frame 10 through the body 27 or 37, and the second end 12 of the bar or bars 6 is adapted to be in contact with the ink blade 2 in a point proximate to the inking edge 23. In FIGS. 1A and 2A the moving means 1 includes only one bar 6, and in FIG. 3 the moving means 1 includes several bars 6 connected parallel to each other. It is also possible to connect several bars in series with each other.

The SMM bar or bars 6 are arranged so within the body 27 or 37 that the longitudinal dimension, i.e. length L can be freely change by an amount of ±ΔL. This means that the first end 11 is stationary against a section 38 of the body 27 or 37, and the second end 12 is movable, whereupon the length L±ΔL is altered by the activating means 7 or 8 or 9 of the moving means 1 according to the invention. The second end 12 of the bar(s) is attached to a contact part 39 or a connecting part 24, which is linearly movable in directions P1, P2 inside and guided in sections 34 by the body 27, 37, as can be readily understood from the figures. Contact part 39 has a nose 28 which moves against the underside 25 of the ink blade segment 3 and bends K the same, whereupon the width G of gap 40 changes, as can be understood from FIGS. 2A and 3, because the blade segments 3 are springy and typically flexible. The connecting part 24 is rigidly attached to a blade segment 3, whereupon the ink blade segments are moved in directions P1, P2 when gliding between the support plate 36 and the foot 41 of the body 27, whereupon the width G of gap 40 changes, as can be understood from FIGS. 1A and 4. The width G of gap 40 between the roller surface 5 and the inking edge 23 adjusts the thickness B of the Ink layer 29 on the surface 5 of the ductor roller 4, which is visualized in FIG. 4. Depending on the type of SMM of the bar 6, an initial length L may be between 7 mm and 30 mm, whereupon the width G of the gap may change from 0 mm to 0.5 mm and vice versa. Said opposite directions P1, P2 towards and away from said ductor roller surface 5 are such that they have a substantial partial vector in direction from the inking edge 23 to the centre line of the axel 26 when divided into two partial vectors perpendicular to each other.

In the first embodiments of the invention, which are shown in FIGS. 1A and 1B, the bar 6 or bars are prepared from a first shape memory material SMM, which is a magnetic field sensitive material, and the activating means 7 are such that they provide a magnetic field strength H±ΔH into said bar or bars. The magnetic field sensitive material is a nickel-gallium-manganese based alloy, or an iron-chromium-boron-silicon based alloy, or an iron-cobalt-titanium based alloy, or an iron-nickel-carbon based alloy, or an iron-manganese-nitrogen based alloy, or some other known or new alloy or material. These kind of materials are described e.g. in publications SU-1611980; Kyprianidis et al.—"*Magnetic phase transition in FeCrBSi alloys*", Journal of Magnetism and Magnetic Materials 161 (1996), 203–208; Webster et al.—"*Magnetic order and phase transformation in $Ni_2MnGa$*", Philosophical Magazine B, vol. 49, No. 3 (1984), 295–310; Kakeshita et al.—"*Magnetoelastic martensitic transformation in an ausagen Fe—Ni—Co—Ti alloy*", Scripta Metallurgica, vol. 19, No. 8 (USA 1985), 973–976; U.S. Pat. No. 5,958,154 and U.S. Pat. No. 6,157,101. High strain up to 5%–6% and high output energy density per unit mass are the advantages of these kind of alloys. The details of compositions, grain structures and phase transformations are not discussed, because the invention intends utilizing of Shape Memory Materials, not the Shape Memory Materials themselves. Said activating means can be either a coil 7 around said bar(s) 6, or a coil 7 around a core 13 of ferromagnetic material, ends 14*a*, 14*b* of which being in contact with said bar(s) 6. When a certain electrical voltage U and current I is fed to said coil 7 a definite magnetic field strength H are attained in said bar(s), which magnetic field strength causes s strain in said bar(s) altering the length L±ΔL of the bar(s). Accordingly by providing a higher or a lower electrical voltage/current U±ΔU, I±ΔI into the activating means 7, in this case the coil, the magnetic field strength H in said bar(s) 6 is changed by an amount ±ΔH, in general the magnetic field strength being H±ΔH, whereupon the longitudinal dimension L±ΔL of said bar(s) is altered thereby adjusting the position of the ink blade, i.e. the width G of the gap 40.

In the second embodiment of the invention, which is generally shown in FIG. 2A, the bar 6 or bars are prepared from a second shape memory material SMM, which is a temperature sensitive material, and the activating means 8 are such that they provide a temperature T±ΔT into said bar or bars. The temperature sensitive material is a titanium-nickel based alloy, which type of alloys are commercially available from several companies, e.g. under the name "Nitinol". These types of alloys are generally called Shape Memory Alloys, and they perform a martensitic⇆austenitic —transformation under inverse changes of temperature, which transformation temperature can be selected to be anywhere between −100° C. and +100° C. High strain up to about 5% and high output energy density per unit mass are the advantages of these kind of alloys, too. Said activating means can preferably be one or several Peltier-elements 8 with first active surface(s) 15*a* against said bar(s) 6 and second active surface(s) 15*b* connected to a thermal conductor 18 outside and thermally isolated, by thermal isolation 16, from said bar(s). Peltier-elements are practical, because they are able to heat the bar(s) when the current I goes to one direction and to cool the bar(s) when the current I goes to opposite direction, the heating and cooling effect depending on the magnitude of the current. For the purpose of the invention a higher or a lower electrical voltage/current U±ΔU, I±ΔI and/or an inverse electrical voltage/current ±U, ±I is fed into activating means 8, in this case Peltier-elements, whereupon various thermal flows T↓↑ to or from said bar or momentarily no thermal flows are attained effecting various temperatures T±ΔT in said bar(s). Accordingly a change ±ΔT of temperature in the bar(s) 6 is created, whereupon the longitudinal dimension L±ΔL of said bar(s) is altered thereby adjusting the position of the ink blade, i.e. the width G of the gap 40.

About the construction of the second embodiment of the invention, it is further disclosed that second active surfaces 15*b* of the Peltier-elements are e.g. in contact with thermal conductors 18, which may be like fins used for cooling power semiconductors and commercially available, the room between the adjacent Peltier-elements and thermal conductors is filled with thermal isolation 16, and the areas of the thermal conductors 18 facing away from the bar(s) 6 and opening into a cooling/heating channel 19, through which a proper fluid is fed to exchange heat to one or the opposite direction.

In the third embodiment of the invention, which is shown in FIG. 3, the bar or bars 6 are prepared from a third shape memory material SMM, which is a voltage sensitive material, especially an electrostrictive material or electrostrictor, and the activating means 9 are such that they provide an electrical voltage U±ΔU and current I±ΔU into said bar or bars. The electrostrictor materials are typically oxide ceramics having a "perovskite" structure, which is generally known definition. "Perovskite" compounds have the general formula $ABO_3$, where the A cation is relatively large and of low valence—such as $Ba^{2+}$, $Sr^{2+}$, $Ca^{2+}$, $Pb^{2+}$, $La^{3+}$, $Sm^{3+}$, $Nd^{3+}$, $Bi^{3+}$, $K^{1+}$,etc. —and the B cation is relatively small and of high valence—such as $Ti^{4+}$, $Zr^{4+}$, $Sn^{4+}$, $W^{6+}$, $Nb^{5+}$, $Ta^{5+}$, $Fe^{3+}$, $Mn^{3+}$, $Mg^{2+}$, $Zn^{2+}$, $Ni^{2+}$, etc. A lead-magnesium-niobate ceramic material is an example, and the electrostrictive material is preferably a single-crystal electrostrictor material, whereupon a relatively high strain up to about 2% and medium output energy density per unit mass are the advantages of these kind of material. Concerning the magnitude of strain, i.e. the available change ±ΔL in a dimension L of the bar(s) it shall be noticed that its effect can be maximized by a proper geometry between the moving direction P1, P2 of the moving means and the position and direction of the ink blade 2 in respect to the ductor roller 4. With an additional mechanism like levers and/or with special configuration of the ink blade the dimensional change ±ΔL can be somewhat amplified, but then avoiding backlash totally is difficult. Magnetostrictive materials have a moderate strain of about 1500 ppm, and piezoelectric materials low strain of about 100–300 ppm, and so magnetostrictive and piezoelectric materials are at least not today practical for use as a SMM bar according to the invention. It shall be kept in mind that new materials are continuously developed, and so the situation can change in the future. The details of compositions, grain structures and phase transformations are not discussed, because the invention intends utilizing of Shape Memory Materials, not the Shape Memory Materials themselves. Said activating means are one or several electrical conductors 9 being in contact with said at least one bar 6. When a controlled higher or lower electrical voltage U±ΔU is fed through the activating means 9, i.e. conductors, into said bars 6 also a respective electrical current I±ΔT is conducted through the bar(s) 6. Accordingly a change ±ΔU, ±ΔI in the voltage between the ends 11, 12 of the bar(s) and in the current through the bar(s) 6 is created, whereupon the longitudinal dimension L±ΔL of said bar(s) is altered thereby adjusting the position of the ink blade, i.e. the width G of the gap 40.

According to a second aspect of the invention the ink blade 2 comprises a plurality of blade segments 3*a*, 3*b*, 3*c*, 3*d* . . . separate from and adjacent to each other, said blade segments 3 having inking edges 23 opposite to the surface 5 of the ductor roller 4 and longitudinal sides 22, which are substantially perpendicular to said inking edges 23 and are in gliding contact with each other, as visualized in FIG. 7. Each of the blade segments 3 are attached to, with a connecting part 24, said at least one bar 6 in each one of said moving means as described above. Said bar or bars 6 are substantially parallel with the longitudinal sides 22 of said blade segments 3*a*, 3*b*, 3*c*, 3*d* . . . and rigidly attached with a connecting part 24 to that underside 25 of each of said blade segments pointing away from the ductor roller 4. To attain Ink tightness between neighbouring blade segments 3*a*, 3*b*, 3*c*, 3*d* . . . the longitudinal sides 22 are preferably provided with e.g. steps, as in FIG. 7, or grooves or the like, which has a configuration matching to each other on the opposite sides of adjacent blade segments 3. In this described alternative the support plate 36 prohibits the excessive bending of the blade segments 3 and keeps the blade segments in a level. In this case the blade segments 3*a*, 3*b*, 3*c*, 3*d* . . . can be quite stiff, because no bending is needed. The blade segments can also be springy and flexible. Because the blade segments 3*a*, 3*b*, 3*c*, 3*d*, 3*e* . . . are independent from each other or separate, each of them is moved linearly in its entirety by its own moving means 1 in to adjust the gap 40. There are at minimum ten blade segments and ten moving means 1 in an adjusting mechanism, but a typical amount of blade segments 3 and moving means 1 is in the order of sixty to hundred. The leak in the traditional construction of the blade segments 3*a*, 3*b*, 3*c*, 3*d* . . . , in which the segments are integral part of the ink blade 2 and formed by slits 45 having limited depth in a direction perpendicular to the inking edge 23, is shown in FIG. 6. When a blade segment 3 is bend more than a neighbouring blade segment a lateral spacing 43 is formed between the sides 22' of the blade segments, whereupon a leak of the Ink is caused which is noticed from streaks 44 of ink on the ductor roller or at least on printed sheet. So that configuration of the ink blade having separate and linearly movable blade segments, described in the beginning of this chapter, are preferred as compared to that configuration of the ink blade having integral and bending blade segments.

The adjusting mechanism comprises also a control unit 20 supplying a controlled electrical voltage/current U, I into the activating means, or more in detail a higher or a lower electrical voltage/current U±ΔU, I±ΔI and/or an inverse electrical voltage/current ±U, ±I into activating means 7; 8; 9 for the bar(s) 6, whereupon a magnetic field strength H or a temperature T or a voltage/current U, I in said bar is changed ±ΔH; ±ΔT; ±ΔU, ±ΔI altering a dimension L±ΔL of said bar(s) thereby adjusting the position of the ink blade. According to the invention the mechanism further comprises a first force sensor 31 positioned between said bar(s) 6 and said frame 10 for detecting the longitudinal compression force F present in the said bar(s). With the aid of this first force sensor 31 the mechanical contact point, marked by G=±0 in FIG. 5, between the ductor roller surface 5 and inking edge 23 can be detected as a response in the compression force F during movement of blade segments towards and against the roller. This step is performed prior to production/printing steps by feeding said electrical voltage/current into activating means 7; 8; 9 which drives the ink blade 2 in direction P1 towards and against the ductor roller surface 5. The value(s) of those electrical voltage and/or current $U_X$, $I_X$ existing at the moment of said contact are stored in a memory to be used later for the control of the ink layer 29 thickness B. The mechanism further comprises a second force sensor 32 positioned between axel 26 of said ductor roller 4 and said frame 10 at that side of the ductor roller, which is opposite to the ink blade 2. With the aid of this second force sensor 32 the point, marked by −g in FIG. 5, in which the play in bearings of the axel 26 is eliminated by pushing the ductor roller 4 with the compression force F of the ink blade in a direction away from the ink blade 2. The play in the bearings is the difference from point ±0 to point −g. The first signal S1 received from said first force sensor and a second signal S2 received from said second force sensor delivered to the control unit 20 are used in a predetermined manner for controlling the voltage U and/or the current I to be fed into said activating means 7; 8; 9. In this way values for initializing the control unit 20 and the calculating means 21 are attained. The control unit 20 comprises calculating means 21 for determining the electrical voltage/current needed for the predetermined movement ±ΔL of said second end 12. The first force sensor 31, the second force sensor 32 can be of any type suitable for the purpose, and the control unit 20, the calculating means 21 as well as said memory can include any electronic components and circuits suitable for the purpose. These types of sensors and electronic components as well as circuits are generally known, and so they are not described more in detail.

What is claimed is:

1. An adjusting mechanism for zonal control of an ink blade in respect of a ductor roller surface in a printing press having a frame, said adjusting mechanism comprising a plurality of moving means in contact with the ink blade and movable in a longitudinal direction towards and away from said ductor roller, wherein each of said moving means comprises:

at least one bar of a shape memory material having a length at least partly in said longitudinal direction, a first end of the at least one bar being supported by said frame and a second end thereof adapted to said contact;

activating means positioned to provide a magnetic field strength or a temperature or an electrical voltage and current into said at least one bar; and said adjusting mechanism comprises:

a control unit supplying a controlled electrical voltage and/or current into the activating means, whereupon the length of said at least one bar is determined by the magnetic field strength or the temperature or the electrical voltage and/or current thereof.

2. An adjusting mechanism according to claim 1, wherein said activating means are one of: i) a coil around said at least one bar; or ii) a coil around a core of ferromagnetic material having ends in contact with said at least one bar; and said control unit is adapted to feed controlled electrical voltage and current to said coil, whereupon various magnetic field strengths are attained in said at least one bar.

3. An adjusting mechanism according to claim 1, wherein said activating means are at least one Peltier-elements with a first active surface against said at least one bar and a second active surface connected to a thermal conductor outside and thermally isolated from said at least one bar; and said control unit is adapted to feed controlled electrical voltage and current to said Peltier-element, whereupon various thermal flows to or from said at least one bar or momentarily no thermal flows are attained effecting various temperatures in said at least one bar.

4. An adjusting mechanism according to claim 1, wherein said activating means are at least one electrical conductors being in contact with said at least one bar; and said control unit is adapted to feed controlled electrical voltage and current to said at least one bar.

5. An adjusting mechanism according to claim 1, wherein the ink blade comprises a plurality of blade segments separate from and adjacent to each other, said blade segments having inking edges opposite to the surface of the ductor roller, and longitudinal sides substantially perpendicular to said inking edges and in gliding contact with each other.

6. An adjusting mechanism according to claim 5, wherein each of the blade segments are attached to or contacted with said at least one bar in each one of said moving means.

7. An adjusting mechanism according to claim 5, wherein said at least one bar is substantially parallel with the longitudinal sides of said blade segments and rigidly attached through a connecting part to an underside of each of said blade segments pointing away from the ductor roller.

8. An adjusting mechanism according to claim 1, wherein said shape memory material is a magnetic field sensitive material.

9. An adjusting mechanism according to claim 8, wherein said magnetic field sensitive material is a nickel-gallium-manganese based alloy, or an iron-chromium-boron-silicon based alloy, or an iron-cobalt-titanium based alloy, or an iron-nickel-carbon based alloy, or an iron-manganese-nitrogen based alloy.

10. An adjusting mechanism according to claim 1, wherein said shape memory material is a temperature sensitive material.

11. An adjusting mechanism according to claim 10, wherein said temperature sensitive material is a titanium-nickel based alloy.

12. An adjusting mechanism according to claim 1, wherein said shape memory material is a voltage sensitive material.

13. An adjusting mechanism according to claim 12, wherein said voltage sensitive material is a lead-magnesium-niobate ceramic material.

14. An adjusting mechanism according to claim 1, wherein the mechanism further comprises a first force sensor positioned between said at least one bar and said frame for detecting the longitudinal compression force present in the said at least one bar.

15. An adjusting mechanism according to claim 14, wherein the mechanism further comprises a second force sensor positioned between an axle of said ductor roller and said frame at a side of the ductor roller opposite to the ink blade.

16. An adjusting mechanism according to claim 15, wherein a first signal received from said first force sensor and a second signal received from said second force sensor delivered to the control unit are used in a predetermined manner for controlling the voltage and/or the current to be fed into said activating means.

17. An adjusting mechanism according to claim 1, wherein the control unit comprises calculating means for determining the electrical voltage and/or current needed for a predetermined movement of said second end.

18. An adjusting mechanism for zonal control of an ink blade in respect of a ductor roller surface in a printing press, said adjusting mechanism comprising a plurality of moving means in contact with the ink blade and movable in a longitudinal direction towards and away from said ductor roller, wherein each of said moving means comprises:

at least one bar of a shape memory material having a length at least partly in said longitudinal direction, activating means positioned to provide a magnetic field strength or a temperature or an electrical voltage and current into said at least one bar; and said adjusting mechanism comprises:

at least one force sensor to detect compression forces between said ink blade and said ductor roller, a control unit supplying a controlled electrical voltage and/or current responsive to said compression forces into the activating means.

19. An adjusting mechanism according to claim 18, wherein said activating means are one of: i) a coil around said at least one bar; or ii) a coil around a core of ferromagnetic material having ends in contact with said at least one bar.

20. An adjusting mechanism according to claim 18, wherein said activating means are at least one Peltier-elements with a first active surface against said at least one bar and a second active surface connected to a thermal conductor outside and thermally isolated from said at least one bar.

21. An adjusting mechanism according to claim 18, wherein said activating means are at least one electrical conductors being in contact with said at least one bar.

22. An adjusting mechanism according to claim 18, wherein the ink blade comprises a plurality of blade segments separate from and adjacent to each other, said blade segments having inking edges opposite to the surface of the ductor roller, and longitudinal sides substantially perpendicular to said inking edges and in gliding contact with each other.

23. An adjusting mechanism according to claim 22, wherein each of the blade segments is attached to or contacted with said at least one bar in each one of said moving means.

24. An adjusting mechanism according to claim 18, wherein said shape memory material is a magnetic field sensitive material, or a temperature sensitive material, or a voltage sensitive material.

25. An adjusting mechanism according to claim 18, wherein said at least one force sensor comprises:

a first force sensor positioned between said at least one bar and said frame for detecting the longitudinal compression force present in the said at least one bar; and a second force sensor positioned between an axle of said ductor roller and said frame at a side of the ductor roller opposite to the ink blade.

26. An adjusting mechanism according to claim 25, wherein the control unit comprises calculating means for determining the electrical voltage and/or current needed for a predetermined movement of said second end.

27. A method for zonal control of an ink layer thickness on a ductor roller by adjusting position of an ink blade in respect of a ductor roller surface in a printing press, in which method a plurality of moving means in contact with the ink blade are moved independently of each other in a longitudinal direction towards and away from said ductor roller, said method comprising the step of:

providing a higher or a lower electrical voltage and/or current and/or an inverse electrical voltage and/or current into activating means for at least one bar of a shape memory material arranged within each of the moving means, whereupon a magnetic field strength or a temperature or a voltage and/or current in said at least one bar is changed altering a dimension of said at least one bar thereby adjusting the position of the ink blade.

28. A method according to claim 27, said method, prior to actual printing operation, further comprising the steps of:

driving the ink blade with said electrical voltage and/or current against the ductor roller surface;

detecting response of a compression force caused by a contact between the ink blade and ductor roller surface during said driving; and storing a value of the electrical voltage and/or current existing at the moment of said contact to be used later for the control of the ink layer thickness.

29. A method according to claim 27, said method further comprising the step of:

individually adjusting gaps between the ductor roller surface and inking edges of a plurality of separate ink blade segments adjacent to each other.

* * * * *